US007364472B2

(12) United States Patent
Kameyama et al.

(10) Patent No.: US 7,364,472 B2
(45) Date of Patent: Apr. 29, 2008

(54) CONNECTOR

(75) Inventors: Isao Kameyama, Shizuoka (JP); Noriko Suzuki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/806,369

(22) Filed: May 31, 2007

(65) Prior Publication Data

US 2007/0298642 A1 Dec. 27, 2007

(30) Foreign Application Priority Data

May 31, 2006 (JP) ..... P. 2006-151664

(51) Int. Cl.
*H01R 13/64* (2006.01)

(52) U.S. Cl. ..... 439/680; 439/271; 439/281

(58) Field of Classification Search ..... 439/271, 439/281, 282, 680, 681
See application file for complete search history.

(56) References Cited

U.S. PATENT DOCUMENTS 3,112,974 A * 12/1963 Curtis et al. ..... 439/292
5,120,246 A * 6/1992 Knox ..... 439/402
6,039,592 A * 3/2000 Shinchi ..... 439/271
6,398,582 B1 * 6/2002 Matsuyama et al. ..... 439/559
7,210,962 B2 * 5/2007 Kameyama et al. ..... 439/589
7,255,585 B2 * 8/2007 Kameyama et al. ..... 439/271

FOREIGN PATENT DOCUMENTS

JP 2005-322532 11/2005

* cited by examiner

*Primary Examiner*—Thanh-Tam Le
(74) *Attorney, Agent, or Firm*—Finnegan, Henderson, Farabow, Garrett & Dunner, L.L.P.

(57) ABSTRACT

A connector includes a seal member holder 20 having a second cylindrical wall 22 for fitting on an outer periphery of a first cylindrical wall 2, and a plurality of groove-like notches 25 and a plurality of engagement holes 27 are formed in the second cylindrical wall, and engagement convex portions 7 for engagement with the respective engagement holes are formed on the outer periphery of the first cylindrical wall. One (25A) of the notches 25 in the second cylindrical wall is larger in width than the other notches, and has a spreading fan-like shape when viewed in plane. A positioning rib 5A having a spreading fan-like shape when viewed in plane is formed on and projects from the outer periphery of the first cylindrical wall, and can be properly fitted only in the notch 25A of the spreading fan-like shape so as to position the seal member holder in the circumferential direction, and when the positioning rib is fitted into any (for example, the notch 25B) of the other notches, the positioning rib interferes walls portions of the second cylindrical wall disposed respectively at opposite sides of this wrong notch to bulge part of the second cylindrical wall outwardly.

3 Claims, 8 Drawing Sheets

CONNECTOR

BACKGROUND OF THE INVENTION

1. Field of the Invention

This invention relates to a connector having a waterproof performance, in which a seal member holder is fitted on a cylindrical wall projecting from a case wall, and a mating connector is fitted to this seal member holder.

2. Description of the Related Art

FIG. 7 is a cross-sectional view of a conventional connector described in Patent Literature 1, and FIG. 8 is a perspective view showing the appearance of a seal member holder used in the connector of FIG. 7.

This connector includes connector terminals 110 projecting from the interior of a case 100 to the exterior thereof through a case wall 101, a first cylindrical wall 102 projecting outwardly from the case wall 101 in surrounding relation to the connector terminals 110, a seal member 120 mounted within the first cylindrical wall 102 to seal a gap between each of the connector terminals 110 and the case wall 101, a seal member holder 200 of a cylindrical shape which is fixedly fitted on an outer periphery of the first cylindrical wall 102 at its proximal end-side second cylindrical wall 202 of a larger diameter, with its distal end-side third cylindrical wall 203 of a smaller diameter projecting toward a mating connector 300, and holds the seal member 120 against withdrawal, a plurality of groove-like notches 205 formed in the second cylindrical wall 202 of the seal member holder 200 at intervals in a circumferential direction thereof and extending axially from an end edge 202*a* of the second cylindrical wall 202, engagement holes 207 formed in the second cylindrical wall 202 in spaced-apart relation to the end edge 202*a* thereof, and engagement convex portions 107 which are formed on and project from the outer periphery of the first cylindrical wall 102 projecting from the case wall 101, and are engaged respectively in the engagement holes 207 by utilizing elastic deformation of the second cylindrical wall 202, thereby retaining the seal member holder 200 against movement in the axial direction.

The mating connector 300 is fitted on this connector, and at this time a housing of the mating connector 300 is fixedly fitted on an outer periphery of the third cylindrical wall 203, with a distal end portion of the housing fitted on the outer periphery of the second cylindrical wall 202 of the seal member holder 200. A lock recess of the mating connector 300 is engaged with a lock projection 208 formed on the outer periphery of the third cylindrical wall 203, so that the two connectors are connected together. The plurality of notches 205 are formed in the second cylindrical wall 202 so that the second cylindrical wall 202 can be easily elastically deformed when engaging the engagement holes 207 of the second cylindrical wall 202 with the respective engagement convex portions 107 of the first cylindrical wall 102.

Patent Literature 1: JP-A-2005-322532

The seal member holder 200 has the lock portion 208 for fixing the mating connector 300, and when this lock portion 208 is disposed in a wrong position, the mating connector 300 can be properly connected to the connector. Therefore, the seal member holder 200 must be fitted on the first cylindrical wall 102, projecting from the case wall 101, in the proper direction.

Therefore, in order that the seal member holder 200 can be properly positioned relative to the first cylindrical wall 102 in the circumferential direction when mounting the former on the latter, it may be proposed to form a positioning rib on the outer periphery of the first cylindrical wall 102 which rib can be engaged in the notch 205 in the second cylindrical wall 205. However, even if the positioning rib is merely formed, and is fitted in the notch 205, there is still a possibility that the seal member holder is mounted in a wrong direction in the case where the plurality of notches 205 are provided.

SUMMARY OF THE INVENTION

This invention has been made in view of the above circumstances, and an object of the invention is to provide a connector in which erroneous fitting of a seal member holder can be detected.

The above object has been achieved by a connector of the present invention having features recited in the following Paragraphs (1) to (3).

(1) A connector including:

connector terminals projecting from the interior of a case to the exterior thereof through a wall of the case;

a first cylindrical wall projecting outwardly from the case wall in surrounding relation to the connector terminals;

a seal member mounted within the first cylindrical wall to seal a gap between each of the connector terminals and the case wall;

a seal member holder of a cylindrical shape which is fixedly fitted on an outer periphery of the first cylindrical wall at its proximal end-side second cylindrical wall, with its distal end-side third cylindrical wall projecting toward a mating connector, and holds the seal member against withdrawal;

a plurality of groove-like notches formed in the second cylindrical wall at intervals in a circumferential direction thereof and extending axially from an end edge of the second cylindrical wall;

a first engagement portion formed at the second cylindrical wall in spaced-apart relation to the end edge thereof; and a second engagement portion which is formed at the outer periphery of the first cylindrical wall, and is engaged with the first engagement portion by utilizing elastic deformation of the second cylindrical wall, thereby retaining the seal member holder against movement in the axial direction;

wherein a housing of the mating connector is fixedly fitted on an outer periphery of the third cylindrical wall, with a distal end portion of the housing fitted on an outer periphery of the second cylindrical wall of the seal member holder; and one of the plurality of notches formed in the second cylindrical wall is larger in width than the other notches; and a positioning rib is formed on and projects from the outer periphery of the first cylindrical wall, and can be properly fitted only in the one notch of a larger width so as to position the seal member holder in the circumferential direction, and when the positioning rib is fitted into any of the other notches, the positioning rib interferes walls portions of the second cylindrical wall disposed respectively at opposite sides of the notch to bulge part of the second cylindrical wall outwardly.

(2) In the connector of the above Paragraph (1), each of the other notches has a rectangular shape when viewed in plane, and has a uniform width from its inlet to its inner end, and the one notch of the larger width is formed into such a spreading fan-like shape that its inlet portion is larger in width than its inner portion and that the width of the inner portion is equal to the width of each of the rectangular notches, and the positioning rib for fitting into the larger-width notch is formed into a spreading fan-like shape conforming to the shape of the larger-width notch.

(3) In the connector of the above Paragraph (1) or Paragraph (2), the positioning rib serves as a first positioning rib, and a second positioning rib is further formed on the outer periphery of the first cylindrical wall, and when the first positioning rib is properly fitted in the larger-width notch, the second positioning rib is fitted in a predetermined one of the other notches to position the seal member holder in the circumferential direction.

In the connector of the construction of the above Paragraph (1), when the second cylindrical wall of the seal member holder is fitted on the first cylindrical wall in a wrong direction, the rib of the first cylindrical wall does not properly fit to the notch of the second cylindrical wall, and the wall portions disposed respectively at the opposite sides of the notch slide onto the larger-width rib, so that part of the seal member holder bulges outwardly. Therefore, by detecting this bulge by the use of a special-purpose jig, the erroneous fitting of the seal member holder (that is, the fitted condition in which its position in the circumferential direction is wrong) can be detected. Alternatively, as a result of formation of the bulged portion on the second cylindrical wall of the seal member holder, the distal end of the housing of the mating connector can not be fitted onto this bulged portion, and the erroneous fitting of the seal member holder can be detected from this.

In the connector of the construction of the above Paragraph (2), the larger-width notch is formed into the spreading fan-like shape such that its inlet has the increased width, and the rib corresponding to this notch is also formed into the spreading fan-like shape. Therefore, as the first and second cylindrical walls are improperly fitted together, the wall portions disposed respectively at the opposite sides of the wrong notch slide onto the rib of the spreading fan-like shape, so that the second cylindrical wall bulges in a generally flaring manner. Therefore, the second cylindrical wall can be much bulged without unduly spreading the inner portion of the improperly-fitted notch, and the erroneous fitting can be easily detected. And besides, the spreading of the inner portion of the erroneously-fitted notch can be suppressed to a small amount, and therefore any crack will not develop in the second cylindrical wall, and a waste of the parts can be reduced when again effecting the fitting operation after detection of the erroneous fitting.

In the connector of the construction of the above Paragraph (3), the two ribs are provided for positioning purposes, and therefore the positioning of the seal member holder relative to the first cylindrical wall when fitting the former to the latter can be effected more properly in a stable manner.

In the present invention, the erroneous fitting of the seal member holder can be detected.

The present invention has been briefly described above. Details of the invention will become more manifest upon reading the following Section "Best Mode for Carrying Out the Invention" with reference to the accompanying drawings.

DESCRIPTION OF THE PREFERRED EMBODIMENTS

A preferred embodiment of the present invention will now be described with reference to the drawings.

Figure 1:
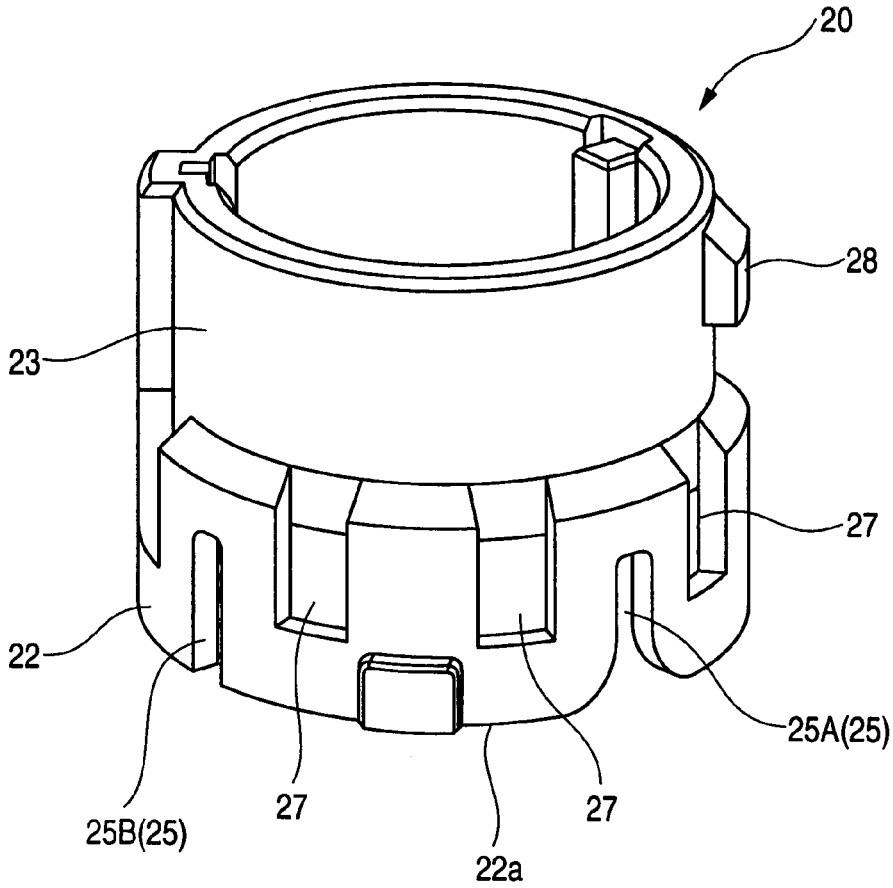
FIG. 1 is a perspective view of a seal member holder of one preferred embodiment of a connector of the invention.
Figure 2:
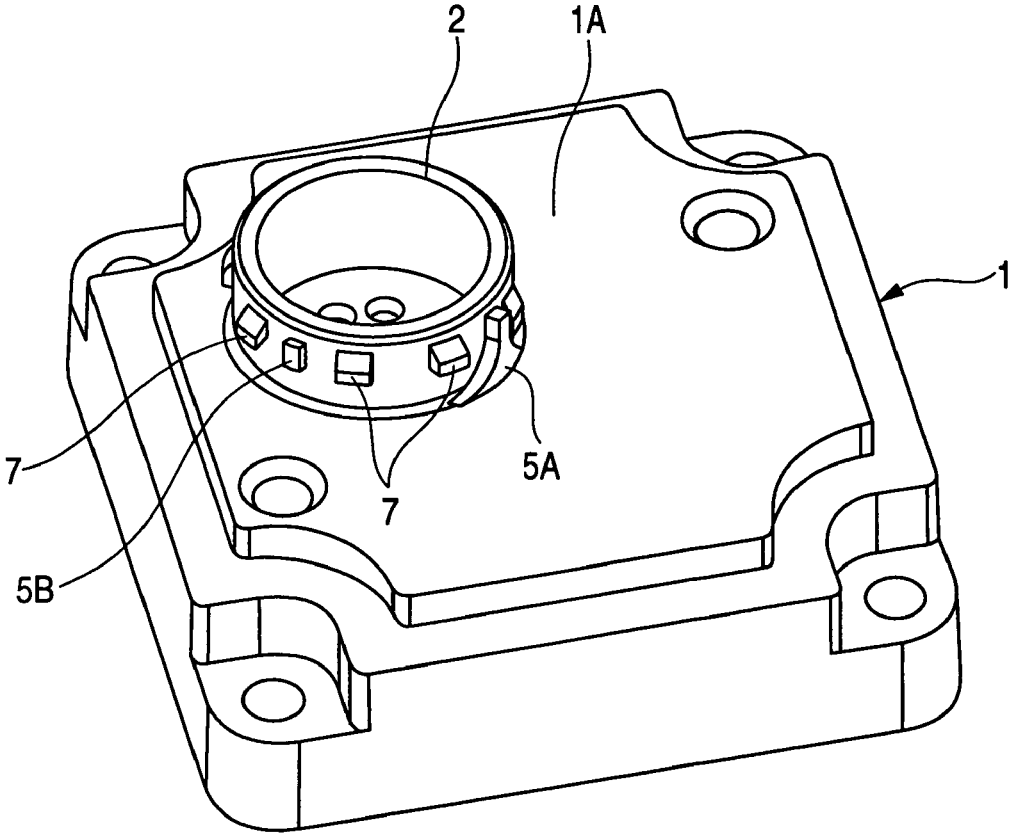
FIG. 2 is perspective view of a case forming the connector of the invention.
Figure 3:
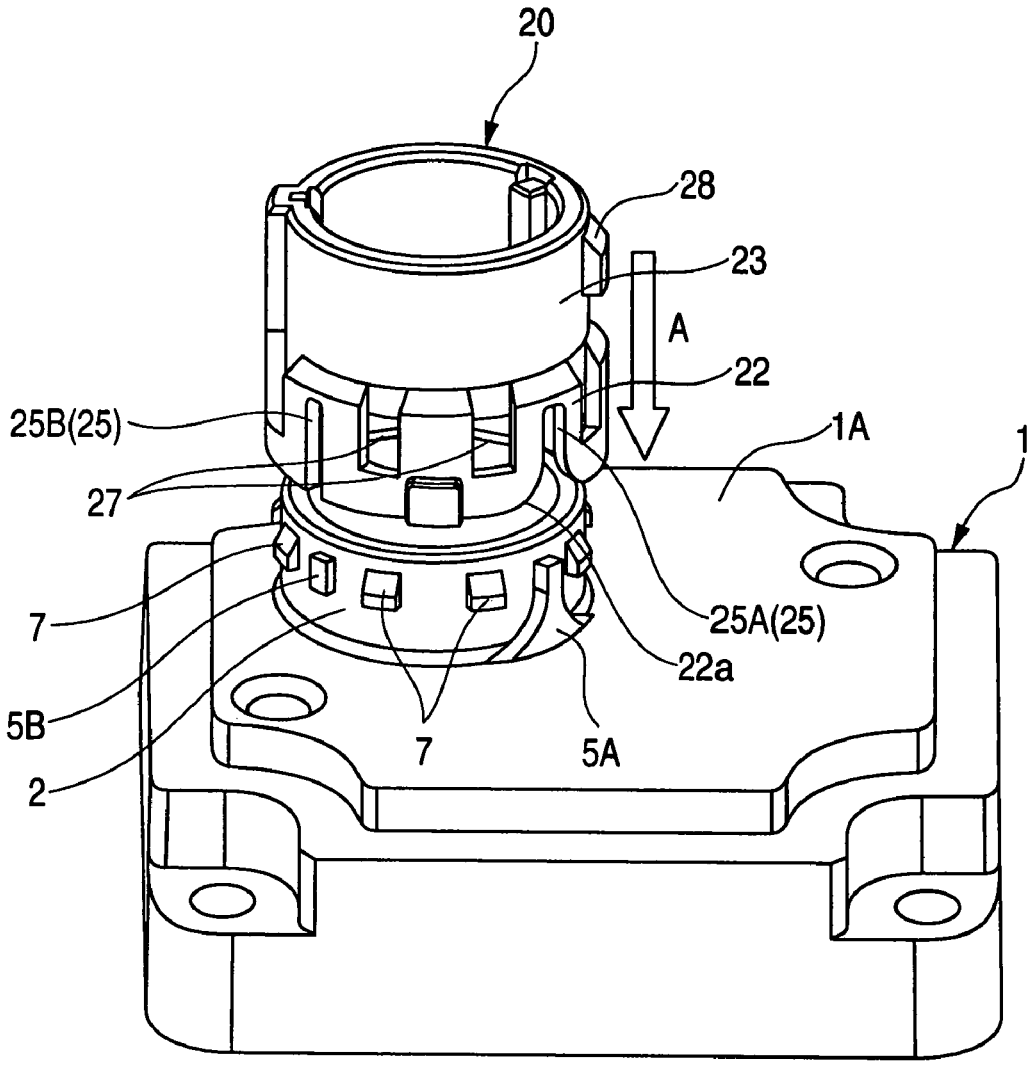
FIG. 3 is a perspective view showing a condition in which the seal member holder is just to be fitted to the case forming the connector of the invention.
Figure 4:
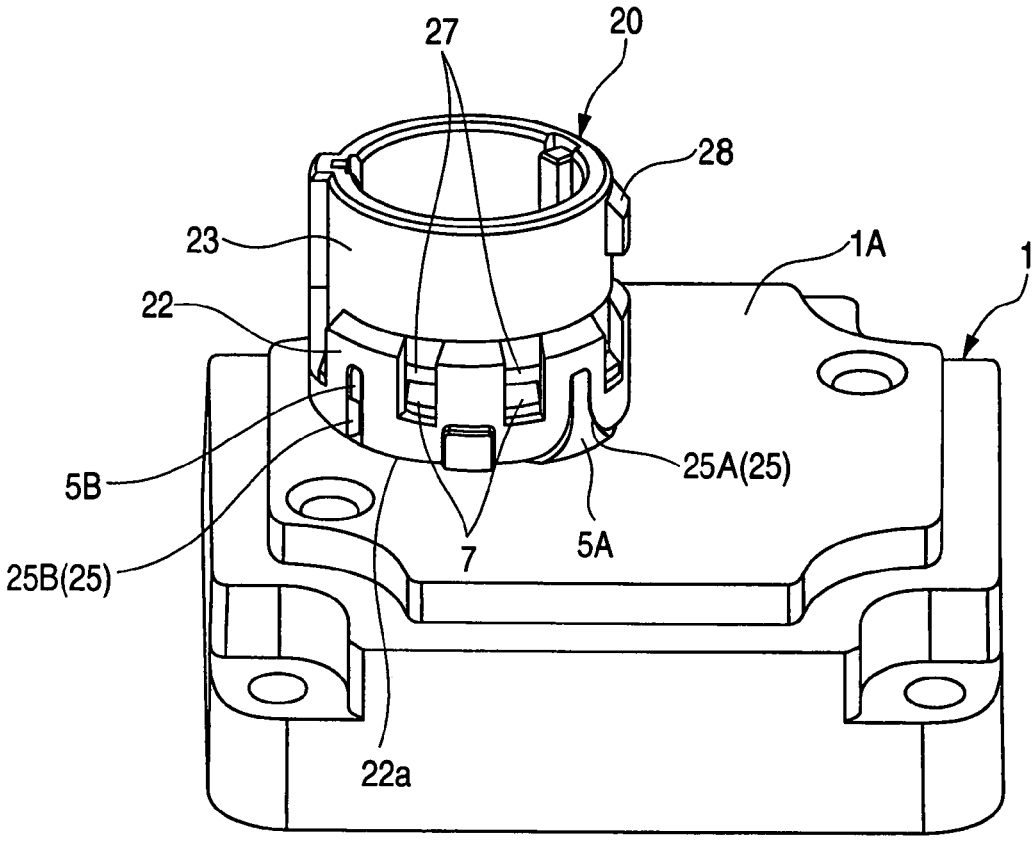
FIG. 4 is a perspective view showing a condition in which the seal member holder is properly fitted to the case forming the connector of the invention.
Figure 5:
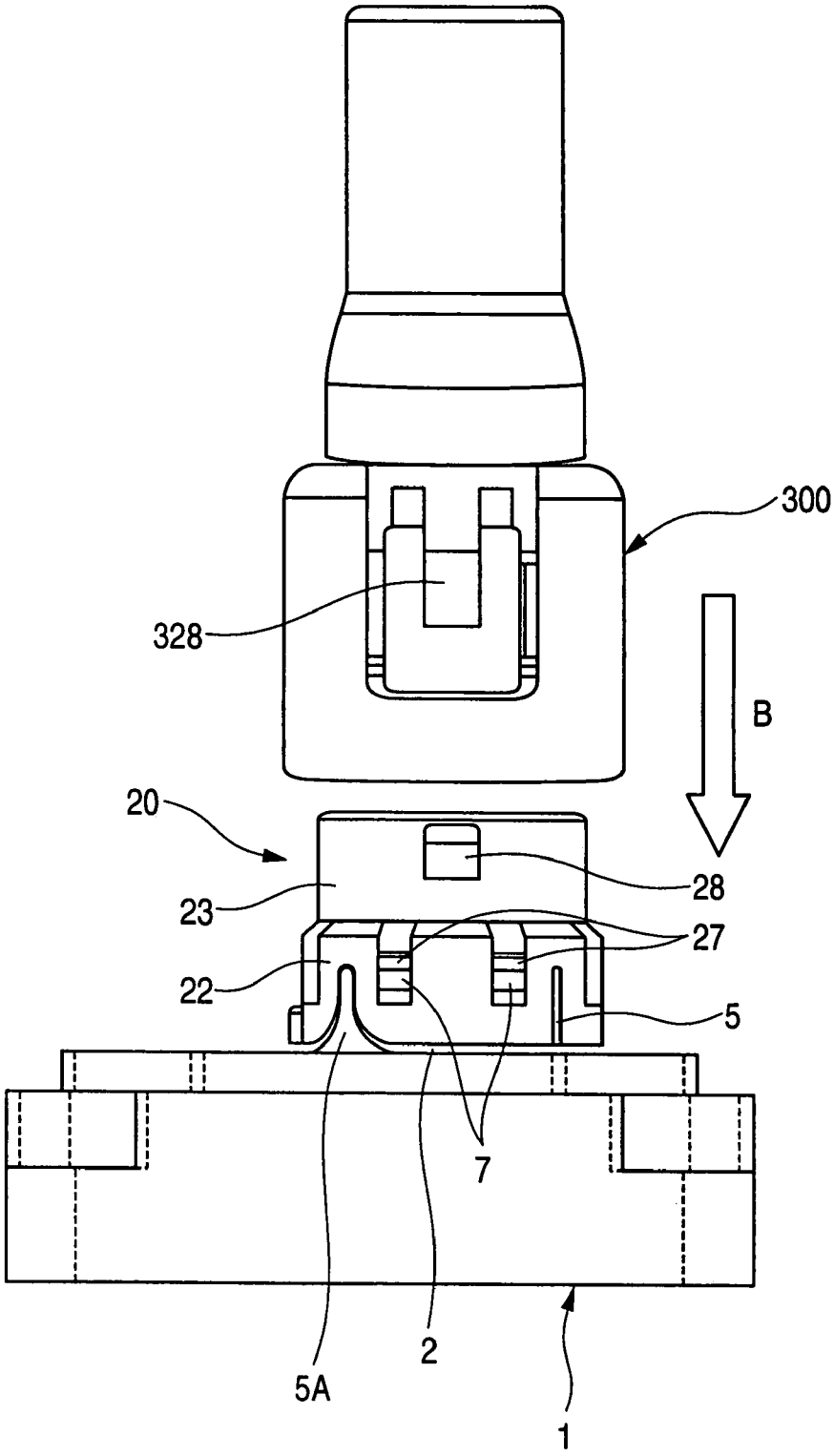
FIG. 5 is a side-elevational view showing a condition in which a mating connector is just to be fitted to the assembled connector of the invention having the seal member holder properly fitted to the case.
Figure 6:
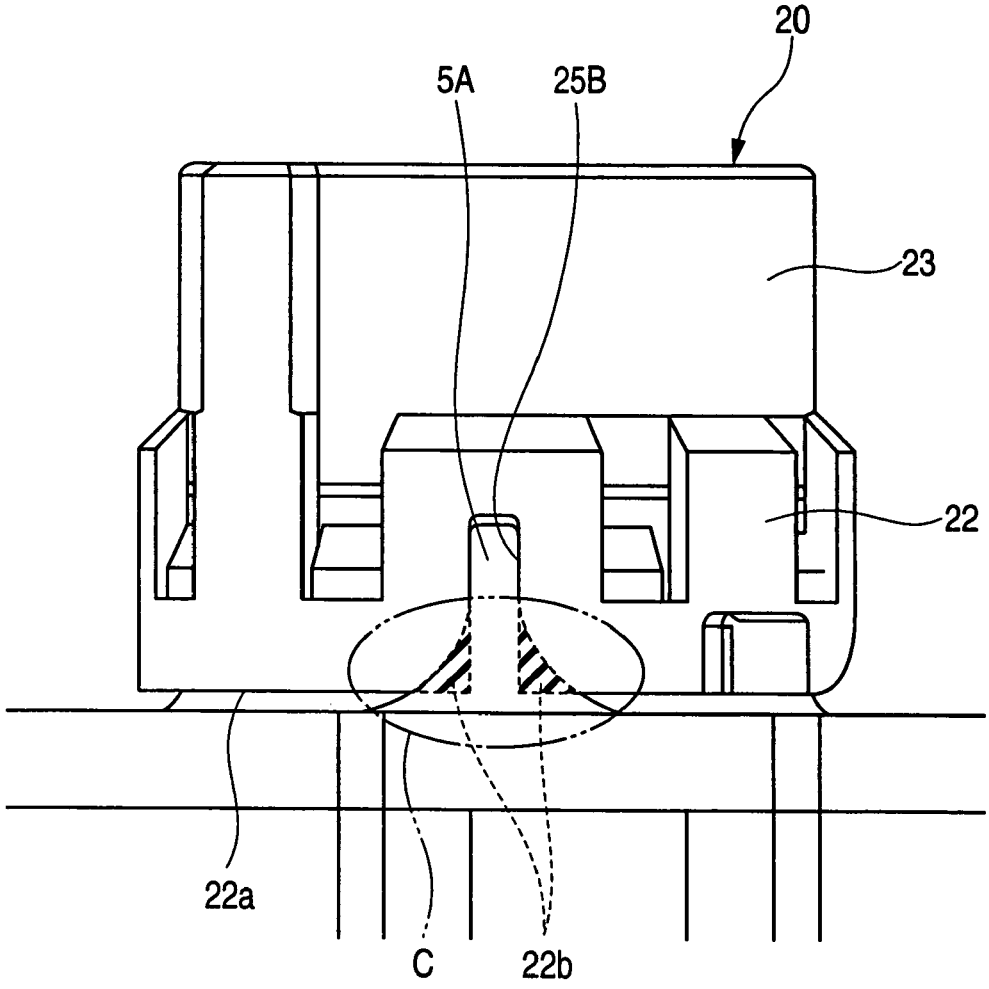
FIG. 6 is a side-elevational view of the connector of the invention, showing a condition in which the seal member holder is fitted to the case in a wrong position.

FIG. 1 is a perspective view of a seal member holder used in one preferred embodiment of a connector of the invention, FIG. 2 is perspective view of a case forming the connector of the invention, FIG. 3 is a perspective view showing a condition in which the seal member holder is just to be fitted to the case forming the connector of the invention, FIG. 4 is a perspective view showing a condition in which the seal member holder is properly fitted to the case forming the connector of the invention, FIG. 5 is a side-elevational view showing a condition in which a mating connector is just to be fitted to the assembled connector of the invention having the seal member holder properly fitted to the case, and FIG. 6 is a side-elevational view of the connector of the invention, showing a condition in which the seal member holder is fitted to the case in a wrong position.

As shown in FIGS. 1 to 3, the connector of this embodiment is provided in a projecting manner on an outer surface of the case 1 containing electrical equipments in a sealed manner, and this connector includes a first cylindrical wall 2 formed on and projecting from a case wall 1A, connector terminals (not shown) provided at a region surrounded by the first cylindrical wall 2, a seal member (not shown) mounted within the first cylindrical wall 2, and the seal member holder 20 fixedly fitted on an outer periphery of the first cylindrical wall 2 to press and hold the seal member.

Figure 7:
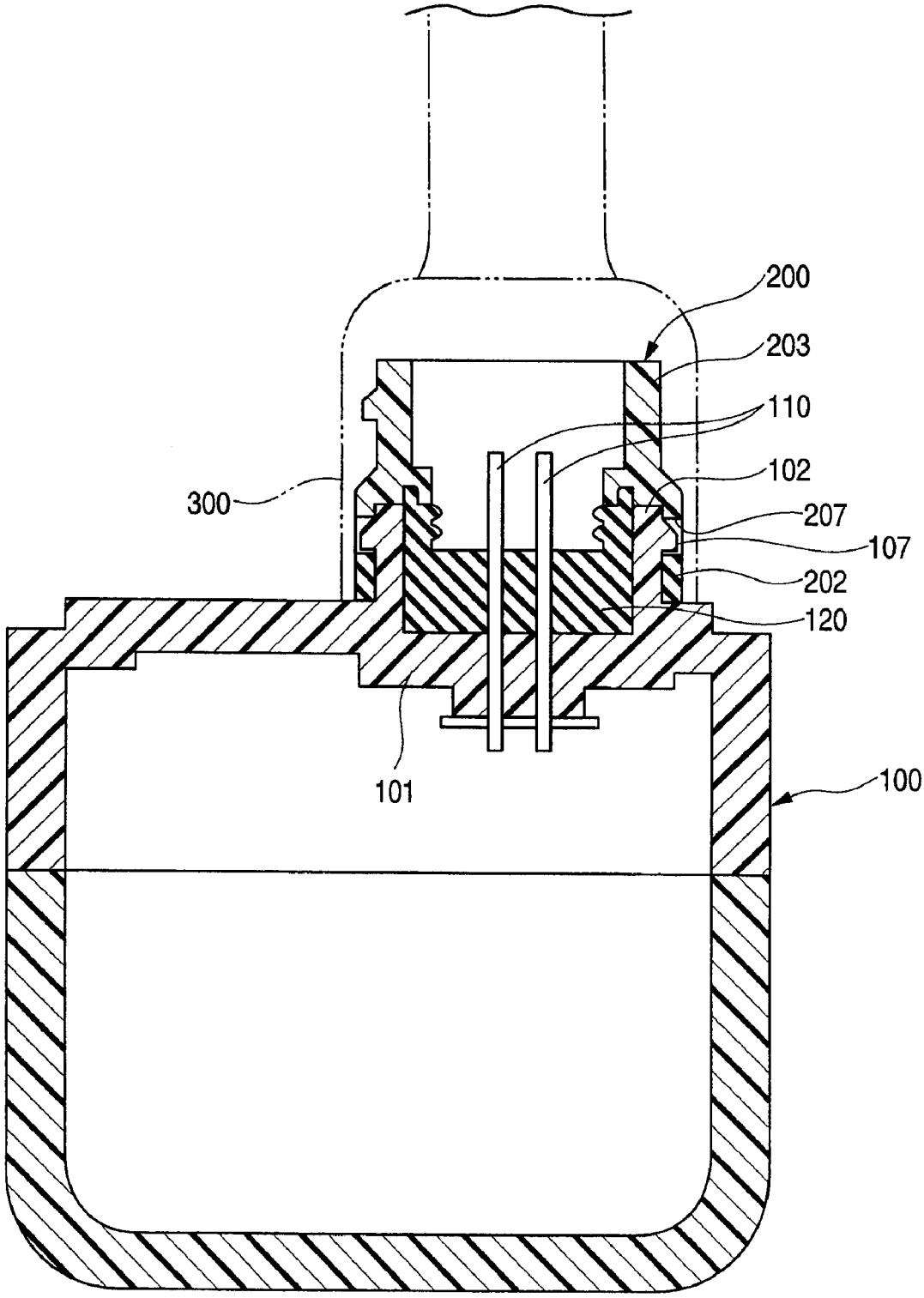
FIG. 7 PRIOR ART
FIG. 7 is a cross-sectional view of a conventional connector.
Figure 8:
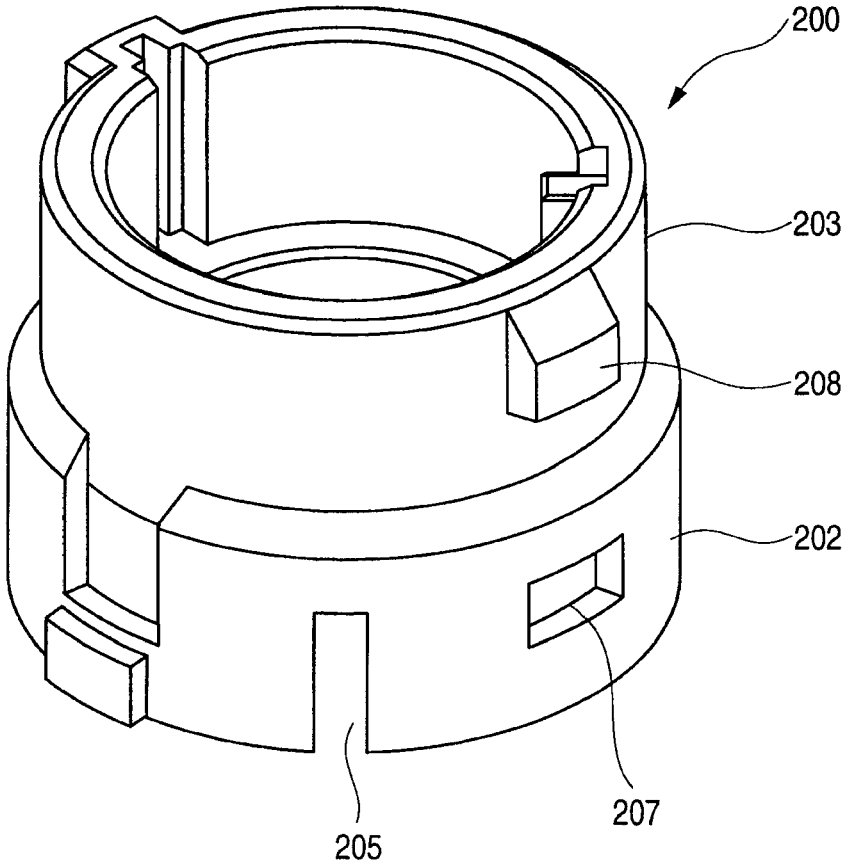
FIG. 8 PRIOR ART
FIG. 8 is a perspective view of a seal member holder of the conventional connector, showing its appearance.

The connector terminals, for example, project from the interior of the case 1 to the exterior thereof through the case wall 1A as described above for the connector of FIG. 7. The first cylindrical wall 2 projects outwardly from the case wall 1A in surrounding relation to the connector terminals, and the seal member is mounted within the first cylindrical wall 2 (see FIG. 7). The seal member, thus mounted within the first cylindrical wall 2, seals a gap between each of the connector terminals and the case wall 1A.

The seal member holder 20 has a generally cylindrical shape as a whole, and is fixedly fitted on the outer periphery of the first cylindrical wall 2 at its proximal end-side second cylindrical wall 22 of a larger diameter, with its distal end-side third cylindrical wall 23 of a smaller diameter projecting toward the mating connector 300 (see FIG. 5). The seal member holder 20, when thus fixedly fitted on the first cylindrical wall 2, holds the seal member against withdrawal, and presses this seal member so as to positively seal the gap between each connector terminal and the case 1.

Two (first and second) positioning ribs 5A and 5B and eight engagement convex portions 7 are formed on and project from the outer periphery of the first cylindrical wall 2. The eight engagement convex portions 7 are arranged at equal intervals (i.e., intervals of 45 degrees) in the circumferential direction. Each of the two positioning ribs 5A and 5B is disposed midway between the corresponding adjacent engagement convex portions 7, and the two positioning ribs 5A and 5B are circumferentially spaced an angle of 90 degrees from each other.

Engagement holes 27 for engagement with the respective engagement convex portions 7 are formed in the second cylindrical wall 22 of the seal member holder 20 in spaced-apart relation to an end edge 22*a* thereof. The engagement convex portions 7 are engaged respectively in the engagement holes 27 by utilizing radially-inward elastic deformation of the second cylindrical wall 22, thereby retaining the seal member holder 20 against movement in the axial direction.

Four groove-like notches 25 are formed in the second cylindrical wall 22 of the seal member holder 20, and are circumferentially spaced an angle of 90 degrees from one another, and extend axially from the end edge 22*a* of the second cylindrical wall 22. Each of the four notches 25 is disposed midway between the corresponding adjacent engagement holes 27.

Two of the four notches 25 are larger in width than the other two, and serve respectively as first and second positioning notches 25A and 25B for fitting respectively to the first and second positioning ribs 5A and 5B. The first positioning notch 25A is different in shape from the other notches 25 (including the second positioning notch 25B). More specifically, each of the other notches 25 has a rectangular shape when viewed in plane, and has a uniform width from its inlet to its inner end. On the other hand, the first positioning notch 25A is increasing in width from its inner end to its inlet, that is, is formed into a spreading fan-like shape. The first positioning notch 25A and the second positioning notch 25B are equal in width at their inner portions, and are different in width only at their inlet-side portions.

The first and second positioning notches 25A and 25B are thus different in shape from each other, and accordingly the rib 5A for fitting in the first positioning notch 25A is formed into a spreading fan-like shape when viewed in plane, while the rib 5B for fitting in the second positioning notch 25B is formed into a rectangular shape when viewed in plane.

Therefore, the first rib 5A can be properly fitted only in the first positioning notch 25A, and when the first rib 5A is fitted into any of the other notches 25 (including the rib 25B) as shown in FIG. 6, the first rib 5A interferes walls portions 22*b* disposed respectively at opposite sides of this notch 25, and serves to bulge part of the second cylindrical wall 22 outwardly.

As shown in FIG. 5, the mating connector 300 is fitted on the connector of this embodiment, and at this time a housing of the mating connector 300 is fixedly fitted on the outer periphery of the third cylindrical wall 23 of the seal member holder 20, with a distal end portion of the housing fitted on the outer periphery of the second cylindrical wall 22. Also, a lock portion 328 of the mating connector 300 is engaged with a lock projection 28 formed on the outer periphery of the third cylindrical wall 23, thereby locking the two connectors to each other in the fitted condition.

The plurality of notches 25 are formed in the second cylindrical wall 22 so that the second cylindrical wall 22 can be easily elastically deformed when engaging the engagement holes 27 of the second cylindrical wall 22 with the respective engagement convex portions 7 of the first cylindrical wall 2, and the two notches among these notches 25 serve also as the positioning notches.

Next, the operation will be described.

For assembling the connector, the seal member is inserted into the interior of the first cylindrical wall 2 of the case 1 having the connector terminals beforehand insert molded therein. In this condition, the seal member holder 20 is pushed in a direction of arrow A as shown in FIG. 3, thereby fitting the proximal end-side second cylindrical wall 22 of the seal member holder 20 on the outer periphery of the first cylindrical wall 2.

At this time, the first and second positioning ribs 5A and 5B are inserted respectively into the first and second positioning notches 25A and 25B extending from the end edge 22*a*, so that the seal member holder 20, while guided by these ribs and notches, is fitted on the first cylindrical wall 2. Then, as the seal member holder 20 is thus fitted on the first cylindrical wall 2, the end portion of the second cylindrical wall 22 including the end edge 22*a* is elastically deformed radially outwardly, and slides over the engagement convex portions 7, and then when the engagement holes 27 are brought into agreement with the respective engagement convex portions 7, this end portion is restored from the elastically-deformed condition, so that the engagement convex portions 7 are engaged respectively in the engagement holes 27, thereby locking the seal member holder 20 to the first cylindrical wall 2.

The first and second positioning notches 25A and 25B are properly fitted respectively on the first and second positioning ribs 5A and 5B as shown in FIG. 4, so that the seal member holder 20 is properly positioned in the circumferential direction. Any bulge is not formed on the second cylindrical wall 22, and therefore the mating connector 300 can be properly fitted on the connector of this embodiment in a direction of arrow B as shown in FIG. 5.

On the other hand, when the second cylindrical wall 22 of the seal member holder 20 is fitted on the first cylindrical wall 2 in a wrong direction, the ribs 5A and 5B of the first cylindrical wall 2 do not properly fit to the positioning notches 25A and 25B, respectively, and for example the wall portions 22*b* disposed respectively at the opposite sides of the second positioning notch 25B of the rectangular shape slide onto the first positioning rib 5A of the spreading fan-like shape as shown in a portion C of FIG. 6, so that part of the seal member holder 20 bulges outwardly.

Therefore, by detecting this bulge by the use of a special-purpose jig, the erroneous fitting of the seal member holder 20 (that is, the fitted condition in which its position in the circumferential direction is wrong) can be detected. Alternatively, as a result of formation of the bulged portion on the second cylindrical wall 22 of the seal member holder 20, the distal end of the housing of the mating connector 300 can not be fitted onto this bulged portion, and the erroneous fitting of the seal member holder 20 can be detected from this.

Particularly, the first positioning notch 25A is formed into the spreading fan-like shape such that its inlet has the increased width, and the first positioning rib 5A corresponding to this notch 25A is also formed into the spreading fan-like shape, and therefore as the first and second cylindrical walls 2 and 22*b* are improperly fitted together, the wall portions 22*b* disposed respectively at the opposite sides of the wrong notch 25B slide onto the rib 5A of the spreading fan-like shape, so that the second cylindrical wall 22 bulges in a generally flaring manner.

Therefore, the second cylindrical wall 22 can be much bulged without unduly spreading the inner portion of the improperly-fitted notch 25B, so that the erroneous fitting can be easily detected. And besides, the spreading of the inner portion of the erroneously-fitted notch 25B can be suppressed to a small amount, and therefore any crack will not develop in the second cylindrical wall 22, and a waste of the parts can be reduced when again effecting the fitting operation after detection of the erroneous fitting.

Furthermore, in this embodiment, the two ribs 5A and 5B are provided for positioning purposes, and therefore the positioning of the seal member holder 20 relative to the first cylindrical wall 2 when fitting the former to the latter can be effected more properly in a stable manner.

Furthermore, in this embodiment, the first cylindrical wall 2 and the seal member holder 20 are engaged with each other through the eight pairs of engagement convex portions 7 and engagement holes 27 which are disposed at equal intervals in the circumferential direction. Therefore, even when a tilting force in an arbitrary direction is applied to the connector from the mating connector 300 fitted thereon, this force can be received by at least two engagement portions in a divided manner regardless of the direction of the force, so that the strength of engagement can be increased. Therefore, it is preferred to provide at least eight pairs of engagement convex portions 7 and engagement holes 27 through which the first cylindrical wall 2 and the seal member holder 20 can be engaged with each other.

The present invention is not limited to the above embodiment, and suitable modifications, improvements, etc., can be made. Also, the material, form, number, disposition, etc., of each of the constituent elements of the above embodiment are arbitrary and are not limited in so far as the invention can be achieved.

For example, in the above embodiment, the engagement convex portions 7 are formed on the outer periphery of the first cylindrical wall 2, and the engagement holes 27 for engagement with the respective engagement convex portions 7 are formed in the second cylindrical wall 22 of the seal member holder 20 in spaced-apart relation to the end edge 22*a* of the second cylindrical wall 22. However, there can be adopted a construction in which engagement holes 27 are formed in the first cylindrical wall 2, and engagement convex portions 7 for engagement with the respective engagement holes 27 are formed on the outer periphery of the second cylindrical wall 22 in spaced-apart relation to the end edge 22*a* of the second cylindrical wall 22.

What is claimed is:

1. A connector including:

a connector terminal projecting from the interior of a case to the exterior of said case through a wall of said case;

a first cylindrical wall projecting outwardly from said case wall in surrounding relation to said connector terminals;

a seal member mounted within said first cylindrical wall to seal a gap between each of said connector terminals and said case wall;

a seal member holder of a cylindrical shape which is fixedly fitted on an outer periphery of said first cylindrical wall at its proximal end-side second cylindrical wall, with its distal end-side third cylindrical wall projecting toward a mating connector, and holds said seal member against withdrawal;

a plurality of groove-like notches formed in said second cylindrical wall at intervals in a circumferential direction thereof and extending axially from an end edge of said second cylindrical wall;

a first engagement portion formed at said second cylindrical wall in spaced-apart relation to the end edge thereof; and a second engagement portion which is formed at the outer periphery of said first cylindrical wall, and is engaged with said first engagement portion by utilizing elastic deformation of said second cylindrical wall, thereby retaining said seal member holder against movement in the axial direction;

wherein a housing of said mating connector is fixedly fitted on an outer periphery of said third cylindrical wall, with a distal end portion of said housing fitted on an outer periphery of said second cylindrical wall of said seal member holder;

one of said plurality of notches formed in said second cylindrical wall is larger in width than the other notches; and a positioning rib is formed on and projects from the outer periphery of said first cylindrical wall, and can be properly fitted only in said one notch of a larger width so as to position said seal member holder in the circumferential direction, and when said positioning rib is fitted into any of said other notches, said positioning rib interferes wall portions of said second cylindrical wall disposed respectively at opposite sides of said notch to bulge part of said second cylindrical wall outwardly.

2. The connector according to claim 1, wherein each of said other notches has a rectangular shape when viewed in plane, and has a uniform width from its inlet to its inner end, and said one notch of the larger width is formed into such a spreading fan-like shape that its inlet portion is larger in width than its inner portion and that the width of said inner portion is equal to the width of each of said rectangular notches, and said positioning rib for fitting into said larger-width notch is formed into a spreading fan-like shape conforming to the shape of said larger-width notch.

3. The connector according to claim 1, wherein said positioning rib serves as a first positioning rib, and a second positioning rib is further formed on the outer periphery of said first cylindrical wall, and when said first positioning rib is properly fitted in said larger-width notch, said second positioning rib is fitted in a predetermined one of said other notches to position said seal member holder in the circumferential direction.

* * * * *